United States Patent [19]

Hibbs et al.

[11] Patent Number: 4,549,578

[45] Date of Patent: Oct. 29, 1985

[54] CODED FLUID CONTROL SYSTEM

[75] Inventors: David A. Hibbs; Wynn P. Rickey; Paul N. Stanton, all of Houston, Tex.

[73] Assignee: Exxon Production Research Co., Houston, Tex.

[21] Appl. No.: 591,733

[22] Filed: Mar. 21, 1984

[51] Int. Cl.[4] ..... F15B 18/00

[52] U.S. Cl. ..... 137/624.11; 137/552.5; 91/167 R

[58] Field of Search ..... 137/624.11, 624.18, 137/624.2, 624.12, 625.11, 552.5, 625.46; 91/36

[56] References Cited

U.S. PATENT DOCUMENTS

| | | | |
|---|---|---|---|
| 3,253,678 | 5/1966 | Osmond | 137/625.46 X |
| 3,702,909 | 11/1972 | Kraikman | 179/18 |
| 3,882,759 | 5/1975 | Formwalt | 91/167 R |
| 3,993,100 | 11/1976 | Pollard et al. | 137/628 |
| 4,185,541 | 1/1980 | Milberger | 137/624.11 X |
| 4,250,929 | 2/1981 | Andreev et al. | 137/607 |
| 4,280,531 | 7/1981 | Milberger et al. | 137/624 |
| 4,356,841 | 11/1982 | Milberger | 137/624 |
| 4,378,848 | 4/1983 | Milberger | 166/362 |
| 4,397,334 | 8/1983 | Harrell | 137/552.5 X |
| 4,407,183 | 10/1983 | Milberger | 91/1 |

OTHER PUBLICATIONS

Keller, G. R., *Hydraulic System Analysis;* Penton/IPC; Fourth Ed. (1978), pp. 124, 125, 173–175.

Milberger, L. J., "Early Failures Pared by New Unit", *Offshore Magazine,* Aug. 1980, pp. 138–144.

*Primary Examiner*—Alan Cohan

*Attorney, Agent, or Firm*—Richard F. Phillips

[57] ABSTRACT

A fluid control system 10 and selector valve 24 for use therein, for controlling a plurality of fluid actuated elements 12, such as valve operators. The fluid actuated elements are controlled from an operating station 52, which is located remotely from the fluid actuated elements 12. Instructions regarding which of the fluid actuated elements 12 it is desired to operate are transmitted by coded signal from the operating station 52 to the selector valve 24, which is positioned proximate the fluid actuated elements 12. The coded signal is transmitted in binary form through a plurality of code input lines 30, each code input line carrying one binary digit of the code. Each of the fluid actuated elements 12 is represented by a corresponding binary code. In response to receiving the binary code corresponding to a given one of the fluid actuated elements 12, the selector valve 24 establishes a fluid circuit serving to introduce fluid pressure to or release pressure from that one of the fluid actuated elements 12, causing it to alter its condition. The present invention is especially well suited for use in the hydraulic control of a satellite well subsea production system.

29 Claims, 8 Drawing Figures

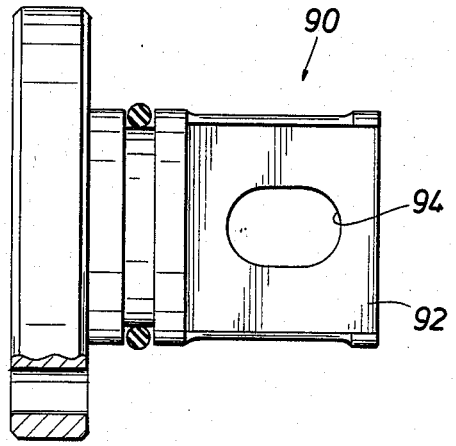
FIG. 5
FIG. 6
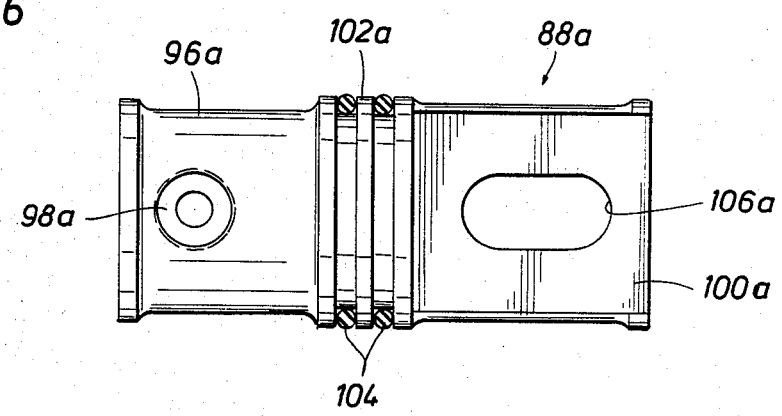
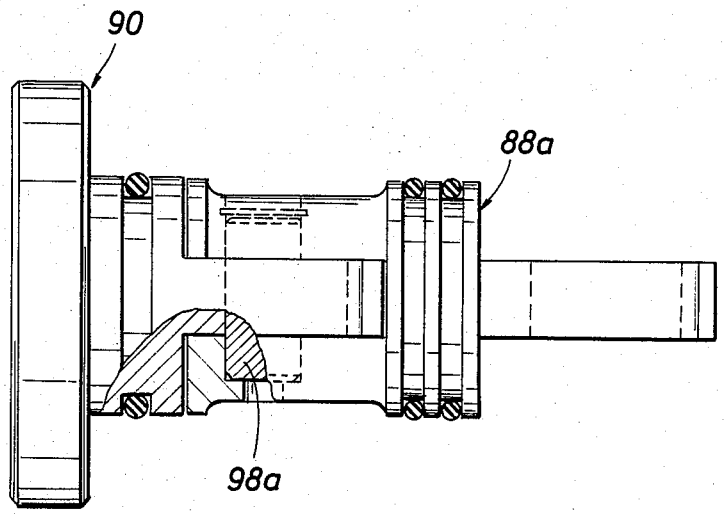
FIG. 7

CODED FLUID CONTROL SYSTEM

FIELD OF THE INVENTION

This invention relates generally to control systems for hydraulic and pneumatic elements. More particularly, this invention relates to hydraulic control systems for controlling the operation of a plurality of valves as, for example, in one or more subsea oil and gas wells.

BACKGROUND OF THE INVENTION

Some of the most significant problems in hydraulic and pneumatic control and power systems involve the transmission of fluid control signals and fluid power over appreciable distances. This is primarily the result of two inherent limitations of such systems relative to electrical control and power systems: the rate of fluid signal transmission is relatively low; and, the cross sectional area of the conduit or passage which transmits the fluid signal or working fluid is relatively great. These two factors are competing; the rate at which a conduit can transmit power and control signals improves as the cross sectional area is increased.

These constraints are not a major concern in many common applications of hydraulic and pneumatic control and power systems, such as in earth moving equipment, where fluid transmission distances are small and size and weight limitations are not a significant consideration. However, there are many applications in which these two limitations of fluid control and power systems impose significant economic and technical disadvantages. Perhaps the most challenging problems in this area are presented by hydraulic control systems for subsea control valves and other equipment situated at relatively great distances from a surface facility from which the valves are controlled.

In offshore oil and gas wells it is common to locate the plurality of control valves required for each well in a subsea tree situated at the seafloor. It is necessary to provide for control of these valves from a surface location, such as an offshore production platform. It has been found that hydraulic control systems are well suited for this purpose.

Existing hydraulic control systems for subsea wells fall into two basic classes, direct acting and indirect acting. In direct acting systems, a discrete hydraulic control line is provided for each hydraulic actuator. Application of hydraulic pressure to a selected control line serves to actuate the corresponding actuator. In the most basic of direct acting systems, a control line is connected directly to the valve actuator, with the hydraulic fluid in the control line serving as the working fluid to operate the subsea valve. In a refinement of the direct acting system, each control line operates a pilot valve. Actuation of the pilot valve connects the valve actuator to a separate source of pressurized working fluid which operates the valve actuator. Though simple and reliable, direct acting hydraulic control systems suffer the disadvantage of requiring a separate control line extending from the ocean surface to the submerged well for each control valve. Where there are a significant number of wells, a large number of control lines is required, yielding a control umbilical of large diameter. The cost of an umbilical having a great number of individual control lines can be substantial. Further, the use of a relatively large diameter umbilical poses especially great problems in deep water wells because of the high loading imposed on the umbilical, relative to a smaller diameter umbilical, in the course of installation. Also, providing means to resist the current and wave induced drag on the relatively large diameter umbilical can pose serious technical problems. Further, direct acting systems are often economically impractical for satellite wells which are located a great distance from the offshore platform from which they are controlled. Not only does the great length of the umbilical impose a significant expense, but anchoring the large diameter umbilical to restrain it from movement caused by current can also add significant cost.

In indirect acting hydraulic control systems, one or more hydraulic control lines are used to transmit coded signals to the wellhead. Typically, these control lines serve only to transmit signals and do not transmit working fluid for operation of the subsea valves. The coded signal transmitted by the control lines is received by a subsea switching valve. The switching valve addresses the subsea valve corresponding to the signal transmitted by the control lines. The use of coded signals avoids the need for a dedicated control line for each valve. This yields a decrease, relative to direct acting systems, in the number of hydraulic lines extending from the surface to the subsea well.

Pressure sequenced control is one of the most common types of indirect acting control systems. Indirect acting systems employ a number of pilot valves, each of which is adapted to operate in a set range of pressure levels. These pilot valves are connected in parallel to a single control line. By application of a selected pressure level to the control line, all of the pilot valves which are set to operate at that pressure level will operate. To ensure accurate operation of such systems, the pilot valve set points must be separated by about 2.8 MPa (400 psi). This limits the number of functions that can be controlled by any one control line. Details of one form of pressure sequenced control system are discussed in U.S. Pat. No. 3,993,100, issued Nov. 23, 1976.

A second type of indirect acting hydraulic control system which has been utilized in the control of subsea wells is disclosed in U.S. Pat. No. 4,356,841, issued Nov. 2, 1982. In this system, a control line extends from a surface control station to a subsea switching valve. The switching valve is adapted to assume a plurality of positions, in each of which it connects a corresponding one of a set of pilot valves to a source of fluid pressure. The switching valve operates through its sequence of positions in response to receiving pressure pulses via the control line. By applying a selected number of sequenced pulses to the control line, a corresponding valve actuator is operated. A disadvantage of this system is that where the length of the control line is great, as is often the case in subsea applications, an appreciable delay must be allowed following each pulse to ensure that the individual pulses remain discrete at the switching valve. This can impose significant delays in the operation of the subsea valves. This system is further disadvantageous in that the subsea valves must be operated in a set sequence.

It would be advantageous to provide a control system for subsea wells and other equipment requiring the control of multiple fluid actuated elements from a remote location in which only a relatively small number of control lines are required, which permits the fluid actuated elements to be operated in any desired sequence, and which is not dependent on the use of sequenced code signals.

SUMMARY OF THE INVENTION

In one aspect of the present invention, a selector valve is provided which is useful in the control of a system having a number of hydraulically or pneumatically actuated elements. The selector valve has an input pressure port and a plurality of outlet pressure ports. The input pressure port is adapted to receive pressurized control fluid. The hydraulically or pneumatically actuated elements are controlled by receipt of pressurized fluid through a control conduit associated with each such element. Each control conduit is selectively supplied with pressurized control fluid from a corresponding one of the outlet pressure ports. The selector valve also includes a plurality of code input ports. Each such code input port receives a fluid pressure signal of either a high or low pressure level. The static combination of the fluid pressure signals applied to each code input port at a given time establishes a binary select code. Each binary select code serves to designate to one or more of the outlet pressure ports. In response to receiving a given select code, the selector valve establishes fluid communication between the input pressure port and the one or more outlet pressure ports designated by the applied select code.

Many advantages of the present invention derive from the use of a binary select code in which the individual bits comprising the select code are transmitted simultaneously, each through a separate fluid conduit. A great number of fluid actuated elements can be addressed by a relatively small number of code transmission conduits. Further, because the various bits of the code are transmitted simultaneously, control is achieved quickly relative to other types of indirect acting fluid control systems. Also, the present invention does not require that the fluid actuated elements be addressed in any desired sequence. Further advantages will become evident upon reading the following detailed description and appended claims.

BRIEF DESCRIPTION OF THE DRAWINGS

For a better understanding of the present invention, reference may be had to accompanying drawings, in which:

FIG. 5 shows an enlarged side view of the actuator endcap;

FIG. 6 shows an enlarged side view of the first actuator piston;

FIG. 7 shows a top view corresponding to FIGS. 5 and 6 with the actuator endcap and first piston in an assembled, fully retracted condition.

These drawings are not intended as a definition of the invention but are provided solely for the purpose of illustrating preferred embodiments of the invention described below.

DESCRIPTION OF THE PREFERRED EMBODIMENTS

Figure 1:
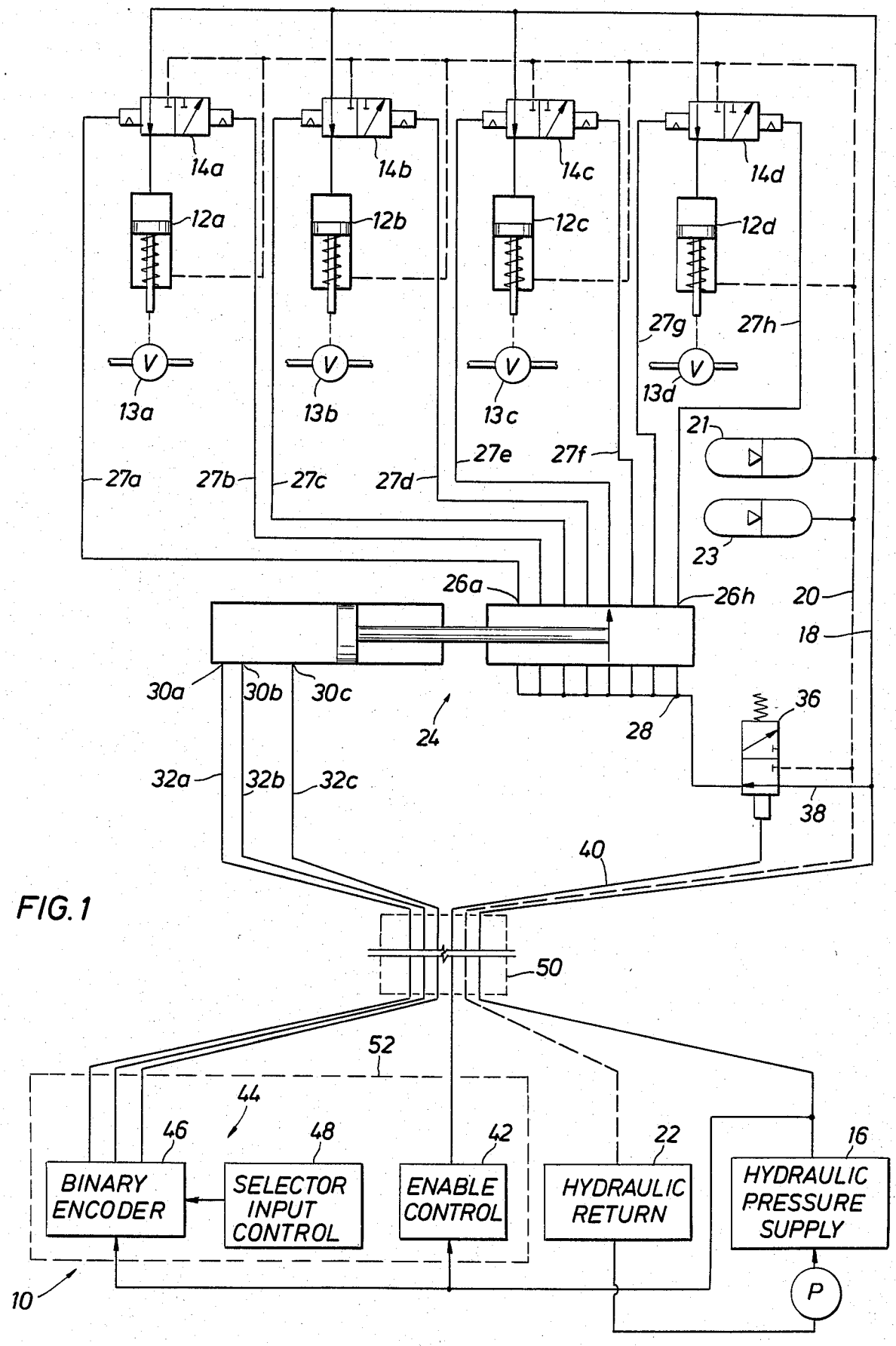
FIG. 1 shows, in diagrammatic form, a basic embodiment of the present invention adapted for controlling four valves in a single well.

A somewhat generalized embodiment of the present invention is diagrammatically illustrated in FIG. 1. The coded control system 10 of the present invention operates a plurality of fluid actuated elements 12*a–d*. As shown in FIG. 1, the fluid activated elements 12*a–d* are single acting, spring return hydraulic cylinders such as might be used as valve operators in the control of the various valves 13*a–d* of a subsea oil well. However, those skilled in the art will recognize that the present invention has a broad range of applications in the field of hydraulic and pneumatic control and is not limited solely to use in oil and gas producing operations. To the extent that the following description is specific to the control of subsea well equipment, this is by way of illustration rather than limitation. Further, though the present invention is equally applicable to hydraulic and pneumatic systems, for the purpose of simplicity in explanation, the following discussion will assume a hydraulic system.

The control system 10 includes four piloted control valves 14*a–d*, each corresponding to one of the fluid activated elements 12*a–d*. Preferably, the piloted control valves 14*a–d* are latching valves. Accordingly, upon activation of one of the control valves 14*a–d* by the application of a pilot signal, the corresponding one of the fluid activated elements 12*a–d* is maintained in the selected condition witout the need for maintaining the pilot signal. The state of the corresponding one of the fluid activated elements 12*a–d* can be changed only by application of the opposite pilot signal. This is especially advantageous in well control, where the state of certain control valves, for example, the surface controlled subsea safety valve, may remain unchanged for protracted periods.

Figure 2:
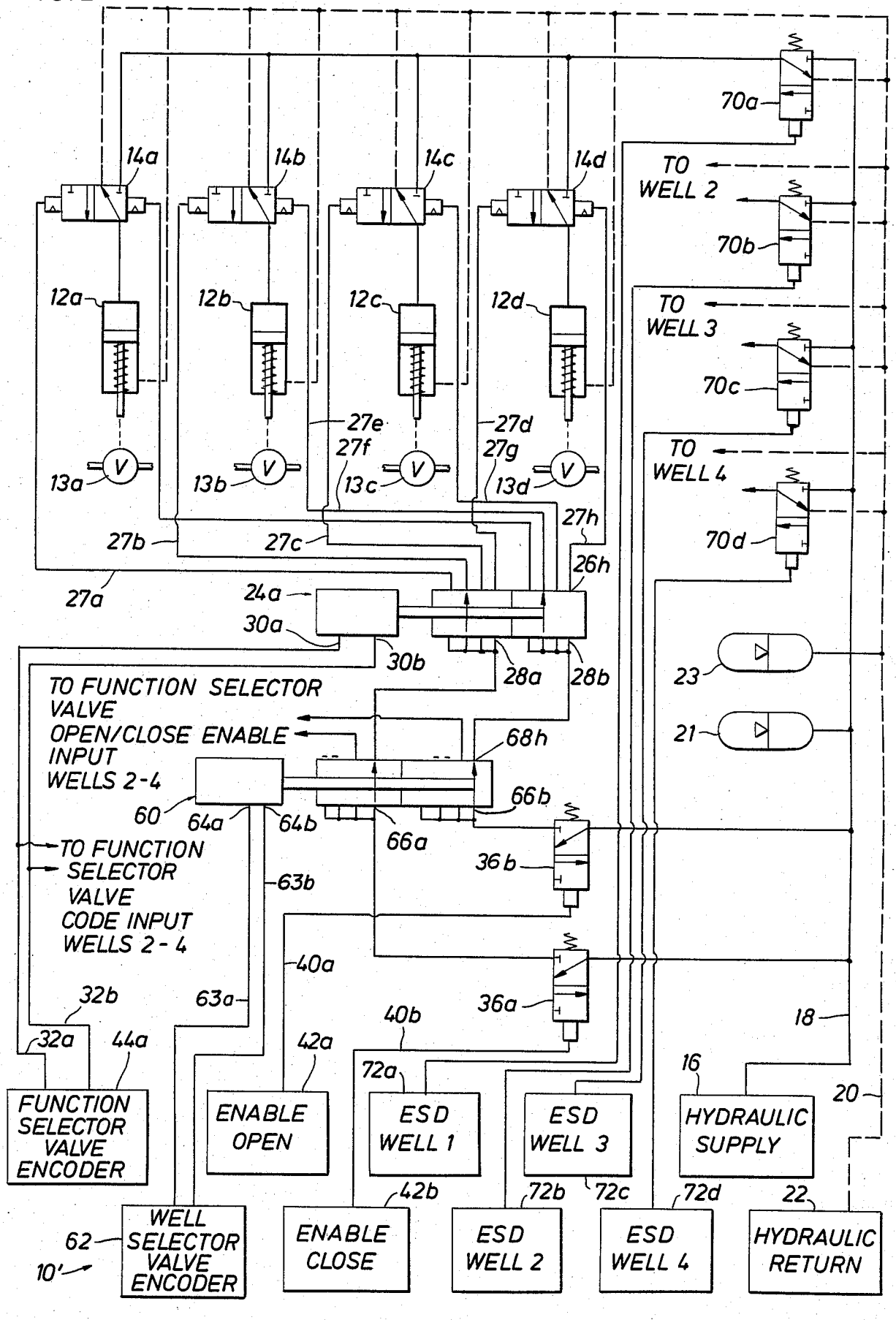
FIG. 2 shows, in diagrammatic form, a somewhat more sophisticated embodiment of the present invention in which multiple valves in each of a plurality of wells can be individually controlled.

A pressurized hydraulic fluid supply 16 is connected through a supply line 18 to each of the piloted control valves 14*a–d*. Similarly, a return line 20 connects the hydraulic return of each piloted control valve 14*a–d* to a fluid return reservoir 22. In FIGS. 1 and 2, all hydraulic return conduits are indicated as dashed lines. A supply accumulator 21 and a surge accumulator 23 are provided, respectively, for the supply and return lines 18,20.

Operation of the piloted control valves 14*a–d* is controlled by a selector valve 24. The selector valve 24 has eight output ports 26*a–h*, grouped in four pairs. Each of these pairs provides the two control functions, via corresponding control conduits 27*a–h*, for a corresponding one of the control valves 14*a–d*. Input pressure from the hydraulic pressure supply 16 is received by the selector valve 24 at a manifolded inlet pressure port 28. The selector valve 24 is also provided with a plurality of code input ports 30*a–c*. These ports 30*a–c*. These ports 30*a–c* receive the hydraulic signal ("select code") used to control the selector valve 24. In response to receipt of a select code, the selector valve 24 adjusts itself to place the one or more of the outlet ports designated by the applied select code in fluid communication with the inlet pressure port 28.

In the preferred embodiment, a binary signal is provided to the code input ports 30*a–c* through code input lines 32*a–c*. Each binary digit (bit) of the select code is applied to a corresponding code input port 30*a–c*. In the embodiment shown in FIG. 1, a three bit binary select code is used, hence only three code input ports 30*a–c* arre provided. However, as will become apparent, in other applications a greater or lesser number of code input ports may be required.

The binary select code is based on two pressure states, a relatively low pressure state and a relatively high pressure state. In the preferred embodiment of the selector valve 24, there is a 0.5 MPa (70 psi) difference between the low and high pressure signals and the low pressure signal is maintained approximately equal to the ambient subsea pressure at the subsea well. In some applications, such as in designs in which it is important to minimize bubble formation in the control fluid, it may be desirable to establish the low pressure signal at a pressure significantly above ambient. Accordingly, it is to be understood that in the present description of the coded control system 10, the terms "low pressure" and "high pressure" are to be interpreted relative to one another and do not indicate absolute pressure. For example, the low and high pressure states in some embodiments could be, respectively, 10 MPa (1450 psi) and 13 MPa (1900 psi).

In the present invention, the select code is a binary signal transmitted by the pressure of the fluid in the code input lines 32*a–c*. A relatively high pressure signal represents one of the two binary digits (bits), while the low pressure signal represents the other of the bits. For example, if the low pressure signal is set at 1 MPa and the high pressure signal set at 4 MPa, a signal in lines 32*c–a* of 4 MPa, 1 MPa, 1 MPa corresponds to a binary code of 1-0-0 (as will be made clear subsequently, line 32*a* transmits the least significant bit). Each of the eight possible permutations of the three bit select code corresponds to a unique one of the eight output ports 26*a–h*. The selector valve 24 incorporates means, described below in conjunction with FIGS. 3–8, for establishing fluid communication between the inlet pressure port 28 and that one or more of the output pressure ports 26*a–h* corresponding to the applied select code. Further details of the construction and operation of the selector valve 24 are set forth subsequently in this description.

The use of separate, parallel signal paths for the transmission of the individual bits of the select code yields numerous advantages. This method permits rapid control of the subsea valves 13*a–d*, relative to serial bit transmission as would be required were only a single code transmission conduit utilized. This is especially important in the control of satellite wells, where signal transmission distances may be several thousand meters. Further, the use of a separate conduit for each bit of the select code simplifies monitoring of the applied select code. It is necessary only to monitor the instantaneous pressure of each code input line to know the applied select code and, hence, the position of the selector valve 24. This monitoring can be performed with pressure gauges or transducers (not shown) situated in the code input lines 32*a–c* positioned proximate the surface location at which the select code is generated. This avoids the need for subsea monitoring of the distribution valve, as is necessary in certain prior art systems.

Application of hydraulic pressure to the inlet pressure port 28 is controlled by an enable valve 36, situated in a hydraulic line 38 joining the inlet pressure port 28 and the pressure supply line 18. Preferably, the enable valve 36 is a single-acting, non-latching, spring returned control valve. Upon actuation by the application of pressure through an enable valve control line 40, the enable valve 36 places the selector valve input pressure port 28 in fluid communication with the pressurized hydraulic fluid source 16. Thus, upon actuation of the enable valve 36, hydraulic pressure is applied to that one of the control valve output ports 26*a–h* which corresponds to the then-existing select code. This serves to actuate the appropriate one of the control valves 14*a–d*, thereby achieving the control valve function selected by application of the select code. When fluid pressure is removed from the enable valve control line 40, the enable valve 36 assumes its non-actuated state. In the non-actuated state the selector valve inlet pressure port 28 is vented to the return line 20. The application of pressure to the enable valve control line 40 is controlled by an enable control 42, which may be a valve situated in a hydraulic line joining the hydraulic pressure supply 16 and the enable valve control line 40.

Means 44 are provided for applying the select code to the code input lines 32*a–c*. The select code applying means 44 includes a hydraulic binary encoder 46 which is supplied with pressurized fluid from the fluid pressure source 16. The binary encoder 46 applies pressurized hydraulic fluid to appropriate ones of the code input lines 32*a–c* to establish the desired select code. In the preferred embodiment, in which the "low" pressure signal is approximately equal to the ambient pressure, the binary encoder 46 can be as simple as a set of manually operated valves. Each of these manually operated valves corresponds to one of the code input lines 32*a–c*, and receives an input supply of pressurized fluid from the fluid pressure source 16. To operate a selected one of the fluid actuated elements 14, the operator would manually adjust each of the valves of the binary encoder 46 to the appropriate "on" or "off" position to deliver the select code corresponding to the desired function of the coded control system 10.

Alternatively, the binary encoder 46 can be controlled from a separate selector input control 48. The selector input control 48 includes a keyboard, rotary dial or other means of receiving an operator input regarding the desired control function. The selector input control 48 controls the valves of the binary encoder 46, causing them to adjust to the on-off positions necessary to yield the select code corresponding to the desired control function. Control of the binary encoder 46 by the selector input control 48 can be achieved in numerous manners well familiar to those skilled in the art of hydraulic control.

To operate the control system 10, the binary encoder 46 is adjusted to apply to the code input lines 32*a–c* that select code which corresponds to the desired function the selected one of the fluid actuated elements 12*a–d*. This causes the selector valve 24 to place the selector valve input port 28 in fluid communication with that one of the selector valve outlet ports 26*a–h* corresponding to the desired function. After the selector valve 24 has established the input port-outlet port fluid communication path corresponding to the applied selector code, the enable control 42 is actuated. This opens the enable valve 36, causing pressurized hydraulic fluid to be applied to the selector valve input port 28. Pressure is then applied through the selected one of the outlet ports 26*a–h* to the corresponding control line 27 of the appropriate one of the piloted control valves 14*a–d*. Because the piloted control valves 14*a–d* are all latched valves, the enable signal and the selector code need be applied only long enough to establish a latched condition. Once this has occurred, the signals applied to the selector valve 24 and the enable valve 36 can be removed.

As will be apparent to those skilled in the art, any of the selector valve outlet ports 26*a–h* could control a plurality of fluid actuated elements 12*a–d*, rather than just a single fluid actuated element as described above. In such an embodiment, a plurality of control conduits 27 would extend from one outlet port, each such conduit providing the control signal for a corresponding fluid actuated element 12. In this manner, the application of a single select code can be used to obtain multiple control functions in a subsea well system.

Further, as will become apparent in view of the subsequent discussion concerning the precise embodiment of the selector valve 24, simultaneous application of the constituent bits of the multi-bit select code is not critical to the operation of the present invention. The individual bits can be applied simultaneously or in any sequence. However, it is preferable that the enable control 42 not be actuated until each bit of the select code is applied.

The present control system 10 is well suited for applications in which the location at which the control signals are applied is spaced a significant distance from the fluid actuated elements 12*a–d*. In the preferred embodiment, the selector valve 24, enable valve 36, piloted control valves 14*a–d* and accumulators 21,23 are all positioned proximate the fluid actuated elements 12*a–d* controlled by the control system 10. The enable control 42 and the selector code applying means 44 are positioned at a remote operating station 52 which, in the case of a subsea well, could be located on an offshore platform or drill ship. The fluid lines 18, 20, 32*a–c*, 40 joining the remote operating station 52 and the subsea well control pod containing the fluid actuated elements 12*a–d* are routed through an umbilical 50. The umbilical 50 provides the necessary protection and support to the individual hydraulic lines.

The use of a binary code system in the present invention lends great economy to the number of hydraulic lines extending between the operating station and the subsea well. For the embodiment shown in FIG. 1, a total of six lines are required to provide all necessary control signals and working fluid supply/return for four well control valves 12*a–d*. Because the control system 10 is based on a binary select code, each added code input line 32 doubles the number of well control valves 12 which the control system 10 will accommodate. Thus, for the type of control system 10 shown in FIG. 1, a total of ten hydraulic lines extending from surface to a subsea well location can control and power sixty-four individual wellhead control valves 12. Further, the present invention does not require that any hydraulic line transmit more than a single signal to obtain any desired control function. Thus, there is no need for sequenced valve control signals. Accordingly, the fluid actuated elements 12*a–d* can be controlled rapidly and in any desired sequence.

Shown in FIG. 2 is a somewhat more sophisticated embodiment of the present invention, adapted for controlling the operations of a cluster of four subsea wells (not shown). The wells each have four fluid actuated elements for controlling various functions of the well. FIG. 2 depicts the fluid actuated elements as valve actuators for a series of subsea well valves 13*a–d*. Each fluid actuated element is controlled by a corresponding pilot valve. For the sake of simplicity, in FIG. 2 only the fluid actuated elements and pilot valves for well number 1 are shown, being represented, respectively, by the reference numerals 12*a–d* and 14*a–d*. It will be understood in the following discussion that corresponding components exist for each of the remaining three wells. It will be further understood that the number of wells controlled, and the number of fluid actuated elements for each well can differ from that shown in FIG. 2 by making changes to the control system 10' of FIG. 2 which will become evident in view of the following discussion.

The pilot valves 14*a–d* of well number 1 are controlled by a function selector valve 24*a*. The function selector valve 24*a* is generally similar in operation to the selector valve 24 described for the embodiment shown in FIG. 1. However, the function selector valve 24*a* of the embodiment illustrated in FIG. 2 has dual input pressure ports 28*a* and 28*b*. Further, the output pressure ports 26*a–h* are divided into two sets, 26*a–d* and 26*e–h*. The function selector valve 24*a* receives a two-bit function select code input at code input ports 30*a,b* and hence can assume only four unique output conditions, each position corresponding to one of the four pilot control valves 14*a–d*. As will be described subsequently in greater detail, the function select code input to the function selector valve 24*a* of each well is applied through a common set of two input lines 32*a,b*. The flow paths intermediate the input and output pressure ports 28*a,b* and 26*a–h* are established such that each of the four possible permutations of the code input will place the first input port 28*a* in fluid communication with a unique one of the first set of output ports 26*a–d* and will simultaneously place the second input port 28*b* in fluid communication with a unique one of the second set of output ports 26*e–h*. The first set of output ports 26*a–d* transmit the signals which cause the control valves 14*a–d* to activate the control elements 12*a–d*. The second set of output ports 26*e–h* transmit the corresponding deactivate signals.

Inputs to the input pressure ports 28*a,b* of the function selector valve 24*a* of each of the wells are controlled by a single well selector valve 60. The well selector valve 60 is preferably identical in construction to the function selector valve 24*a*. A well selector valve encoder 62 transmits a two-bit well select code through two well select code input lines 63*a,b* to well selector valve code input ports 64*a,b*. Each of the four possible permutations of the two-bit well select code corresponds to one of the four wells. In common with the function selector valve 24*a*, the well selector valve 60 has a first input pressure port 66*a* corresponding to a first set of four output pressure ports 68*a–d* and a second input pressure port 66*b* corresponds to a second set of four output pressure ports 68*e–h*. As indicated in FIG. 2, each port of the first set of well selector valve output pressure ports 68*a–d* is paired with a corresponding one of the second set of well selector valve output pressure ports 68*e–h* to form four well control signal pairs. Each such signal pair provides the control input to the input pressure ports 28*a,b* of a corresponding one of the four function selector valves 24*a*. For example, in FIG. 2 ports 68*d,h* provide the two inputs, respectively, to input ports 28*a,b* of the well number one function selector valve 24*a*. Similarly, ports 68*c* and *g* provide the two inputs to the input ports of the well number two function selector valve (not shown), etc.

As previously stated, each of the four wells has its own function selector valve 24*a*. The function code to each function selector valve 24*a* is received from means 44*a* for applying the function selector code, which is situated at the remote operating station. The function code is transmitted through code input lines 32*a* and *b*, the four function selector valves 24*a* each being connected in parallel to these lines 32*a,b*. Thus, the four function selector valves 24*a–d* operate in coordinated fashion, always addressing corresponding pilot control valves 14 for each of the wells.

The well selector valve input pressure ports 66*a,b* are connected to the hydraulic pressure supply 16 through separate enable valves 36*a,b*. Preferably the enable valves 36*a,b* are single acting, spring return pilot valves. These valves 36*a,b* are controlled by enable open and enable close controls 42*a,b* in the same manner as is used for the enable valve 36 of the embodiment shown in FIG. 1.

An emergency shut down ("ESD") feature for each well is provided by piloted, spring return shut down valves 70*a–d*. Each of these shut down valves 70*a–d* is situated in series with and upstream of the hydraulic pressure supply line to the corresponding well. An emergency shut down control 72*a–d* for each well provides pilot pressure to the corresponding shut down valve 70*a–d*. By maintaining pilot pressure from each of the emergency shut down controls 72*a–d* to the corresponding shut down valve 70*a–d*, the hydraulic pressure input for each of the piloted control valves 14*a–d* remains in fluid communication with the hydraulic pressure supply 16. However, operating the emergency shut down control 72*a–d* for any well will serve to remove pilot pressure from the corresponding one of the shut down valves 70*a–d*. This causes the pressure supply line to all pilot control valves of the affected well to be vented to hydraulic return 22. This results in the fluid actuated elements 12 of that well assuming a de-energized (closed) position, shutting in the well.

Alternately, a single emergency shut down control (not shown) can be provided for all wells. In such an embodiment, a single shut down valve is placed in the hydraulic supply line 18 at a position upstream of the wells. This shut down valve is controlled by a single emergency shut down control.

Operation of the control system 10' of FIG. 2 is similar to that of FIG. 1. The well selector valve encoder 62 is operated to apply the select code corresponding to the well to be controlled. The function selector valve encoder 44*a* is operated to apply the select code corresponding to the specific valve to be controlled. Following the application of the select codes, the enable open control 42*a* or enable close control 42*b* is actuated, depending on whether it is desired to open or close the selected valve. Once the selected valve assumes the desired state, all control signals may be removed.

Figure 3:
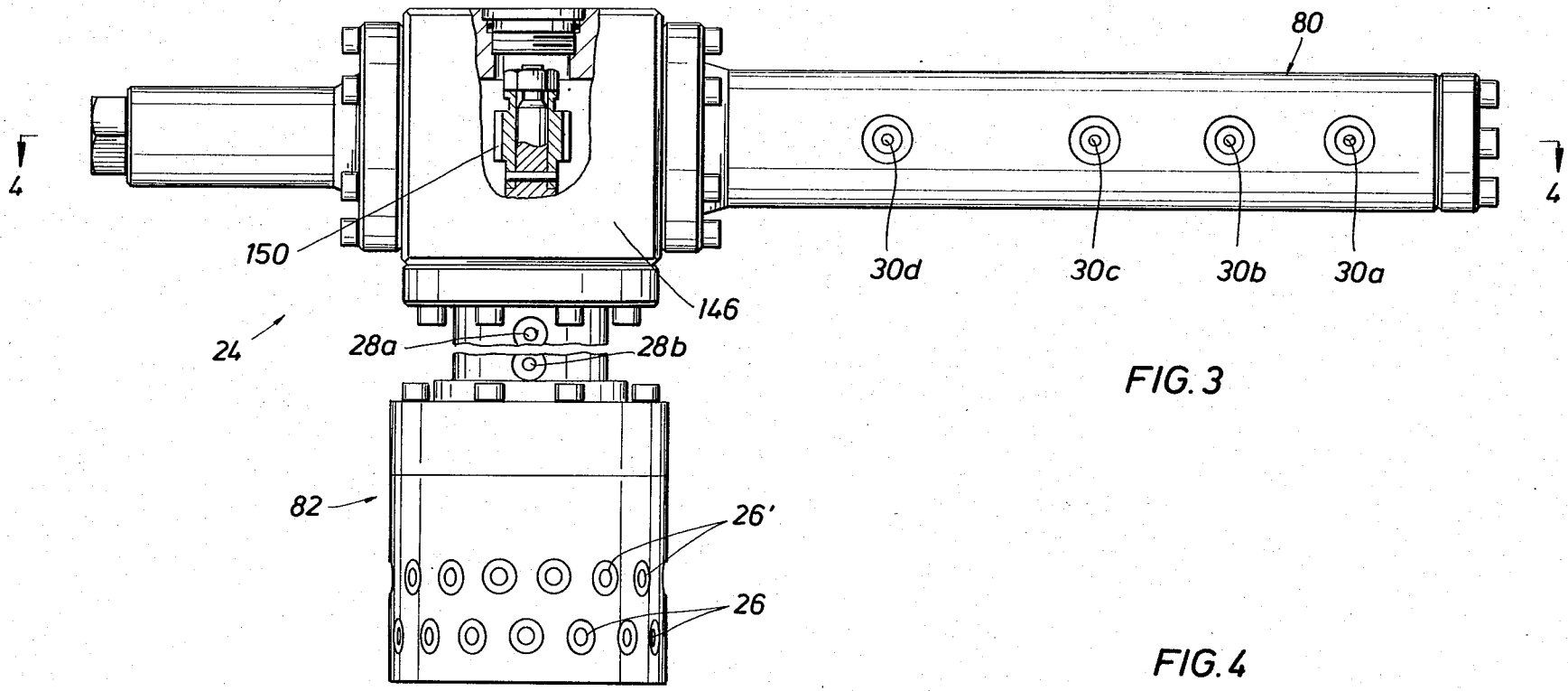
FIG. 3 shows a side view of the selector valve, a portion of the gearbox housing being broken away to show details of the gear and spindle assembly of the selector valve.

A preferred embodiment of the selector valve 24 is shown in FIG. 3. The selector valve 24 of FIG. 3 is adapted to receive a four-bit code input at input ports 30*a–30d* and in response thereto to provide an establish fluid communication between a first input pressure port 28*a* and a selected one of sixteen first output pressure ports 26*a–p*, and between a second input pressure port 28*b* and a selected one of sixteen second output pressure ports 26'*a–p*. It will be recognized that the selector valve 24 described below and shown in FIG. 3 can assume sixteen unique positions. Having dual sets of input-output pressure paths, the selector valve 24 of FIG. 3 can control up to 32 separate functions, enough for sixteen double acting control valves 14. This is a significantly greater number than is required by the basic control systems 10 of FIGS. 1 and 2. As will be readily apparent, selected ones of the input, output and code input ports 26, 28, 30 of the selector valve 24 can be plugged to adapt it for such simpler service. Alternately, the selector valve 24 can be scaled down or up in control capacity by altering the number of stages in the actuator and the type of shear seal valve employed, as will become apparent in view of the following discussion.

The selector valve 24 includes an actuator 80 and a flowpath control element 82. Preferably, the flowpath control element 82 is a multiple position valve adapted for establishing fluid communication between each of the input pressure ports 28*a,b* and a selected one of the plurality of output pressure ports 26*a–p*, 26'*a–p*. The actuator 80 is adapted for receiving the select code and setting the flowpath control element 82 to the position necessary to achieve the corresponding input pressure port-output pressure port communication. The selector valve 24 includes means 84 for interfacing the actuator 80 and multiple position valve 82 such that each select code corresponds to a selected output port from each of the output port sets 26*a–p*, 26'*a–p*. In the embodiment shown in FIG. 3, the actuator 80 is a four-bit, 16 position linear actuator; the multiple position valve 82 is a two port input—2×16 port output rotary shear seal valve; and the interfacing means 84 is a rack and gearbox assembly.

Figure 4:
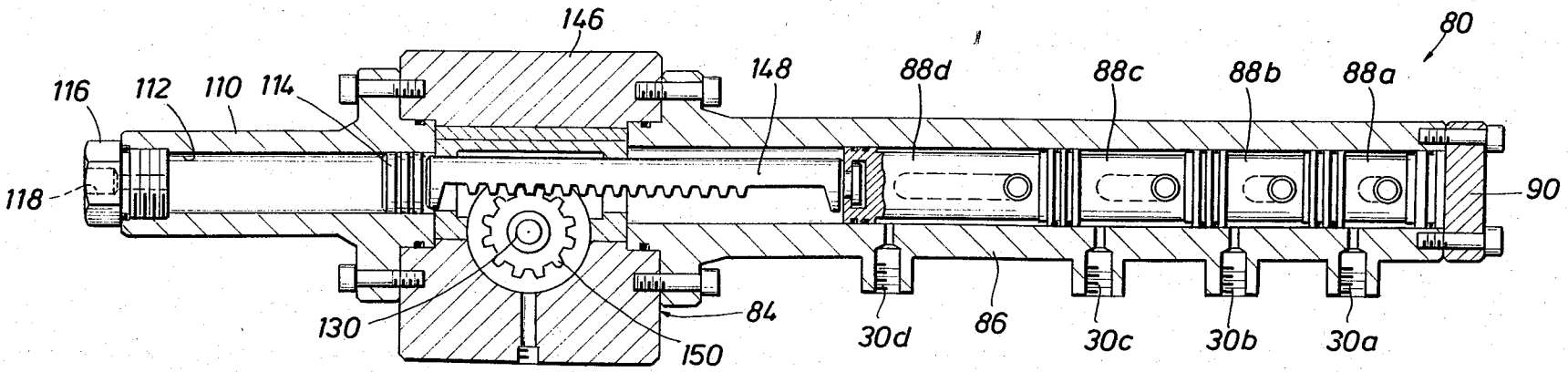
FIG. 4 shows a top view of the linear actuator and gearbox with the housings of these elements cut away along a horizontal bisector of the actuator to reveal the inner components.

A preferred embodiment of the actuator 80 is shown in FIG. 4. The actuator 80 includes a generally cylindrical housing 86 containing four interconnected pistons 88*a–d*, each corresponding to one of the code input ports 30*a–d*. An endcap 90 of the actuator housing 86, best shown in FIG. 5, has a guide portion 92 projecting into the cylinder defined by the housing 86. The endcap guide portion 92 has an oval slot 94 extending transversely therethrough.

Referring to FIG. 6, the first piston 88*a* has a clevis portion 96*a* adapted to surround the endcap guide portion 92. A pin 98*a* extends across the clevis portion 96*a* through the oval slot 94 of the endcap guide portion 92. Thus, the longitudinal dimension of the endcap oval slot 94 defines the limits of extension and retraction of the first piston 88*a* within the actuator housing 86. The interface between the first piston 88*a* and the endcap 90 is detailed in FIG. 7, showing the first piston 88*a* in the fully retracted position.

The first piston 88*a* also has a guide portion 100*a* extending in a direction away from the clevis portion 96*a*. Intermediate the first piston clevis and guide portions 96*a*,100*a* is a central sealing portion 102*a* adapted for receiving O-rings or other sealing elements 104. The central sealing portion 102*a* establishes a radial sealed interface between the two ends of the first piston 88*a*.

As shown in FIG. 4, the second, third and fourth pistons 88*b–d* are generally similar in construction to the first piston 88*a*, each having a clevis portion with a pin extending through the oval slot 106 of the preceeding piston 88*a–c*. The last piston 88*d* need not have a guide portion. The last piston 88*d* serves as the output member of the actuator 80.

Each piston 88*a–d* is adapted for longitudinal motion in the actuator housing 86, mechanical restraint being applied only at the clevis portion 96—guide portion 100 interface between the pistons 88*a–d* and at the endcap 90—first piston 88*a* interface. The latter interface serves as the anchor point for the entire piston assembly.

As shown in FIG. 4, each of the code input ports 30*a–d* is associated with a corresponding one of the pistons 88*a–d*. Application of a pressure signal at the first code input port 30*a* causes the first piston 88*a* to move in a direction away from the endcap 90 until the first piston clevis pin 98*a* contacts that end of the endcap guide portion oval slot 94 nearest the first piston 88*a*. This position represents full extension of the first piston 88*a*. Similarly, application of a pressure signal to the second code input port 30*b* will cause the second piston 88*b* to move in a direction away from the first piston 88*a* until the second piston clevis pin contacts that end of the first piston oval slot 106*a* nearest the second piston 88*b*, this representing full extension of the second piston 88*b*. The third and fourth pistons 88*c,d* operate in the same manner.

The clevis portions 96, guide portions 100 and oval slot portions 106 of each piston 88*a–d* have longitudinal dimensions arranged such that maximum travel of the fourth piston 88*d* relative to the third piston 88*c* is twice that of the third piston 88*c* relative to the second piston 88*b*, etc. This is indicated in FIG. 4.

Means are provided for biasing the fourth piston 88*d* in a direction toward the endcap 90 in response to the absence of a high pressure code signal at port 30*d*. As shown in FIG. 4, a second generally cylindrical housing 110 is connected to the first housing 86 at that end of the first housing opposite the endcap 90. The two housings 86, 110 are axially aligned. The second housing 110 defines a cylinder 112 of smaller diameter than the first housing 96. A return piston 114 is positioned in the second housing cylinder 112 and adapted for axial movement therein. The return piston 114 and fourth piston 88*d* are mechanically linked by a gear rack 148.

In the operation of the fourth piston biasing means, the second housing cylinder 112 is maintained at a constant pressure equal to that of the high pressure signal used in the select code. This pressure is applied through a port 118 in an endcap 116 of the second housing 110. Accordingly, in the absence of a high pressure signal to any of the actuator pistons 88*a–d*, return piston 114 moves in direction toward the endcap 90, biasing each actuator piston 88*a–d* in the direction of the endcap 90. If, however, any single piston 88*a–d* is actuated by the application of pressure at its corresponding code input port 30*a–d*, that piston and any pistons relatively nearer the return piston 114 will move toward the return piston 114 by an amount equal to full travel of the activated actuator piston. The return piston 114 will always be displaced by activation of any of the actuator pistons because it has a smaller diameter than do the actuator pistons 88*a–d*, and hence will exert a smaller force in response to the application of equivalent hydraulic pressure. The actuator pistons nearer the endcap 90 than the activated actuator piston remain biased in the retracted position as a result of the pressure imbalance between the high pressure of the activated actuator piston and the low pressure of the non-activated actuator pistons.

The same relations hold for activation of a plurality of the actuator pistons 88*a–d*. Consider, for example, the application of a pressure signal only to code input ports 30*d* and 30*b*. The fourth actuator piston 88*d* will be fully extended from the third actuator piston 88*c* because the force acting on the fourth actuator piston 88*d* overcomes that acting on the return piston 114. In similar fashion, the second actuator piston 88*b* will be fully extended relative to the first actuator piston 88*a*. The first and third actuator pistons 88*a,c* will remain in their unextended state due to the force caused by the pressure imbalance return piston 114, which biases toward the endcap 90 all actuator cylinders to which a pressure signal is not applied.

As previously detailed, the ratios of independent travel of the first through fourth actuator pistons 88*a–d* is 1:2:4:8. Accordingly, the displacement of the actuator output member (the fourth actuator piston 88*d*) is controlled in a binary manner by code input ports 30*a–d*. Thus, the signal 1-1-1-1 (a "1" representing the high pressure signal and "0" representing the low pressure signal) at ports 30*d–a* causes the fourth piston 88*d* to travel 15 units, while 0-0-0-0 represents a total actuator travel of 0 units. The remaining 14 permutations of the 4-bit binary code provide the intermediate 14 actuator displacements.

Figure 8:
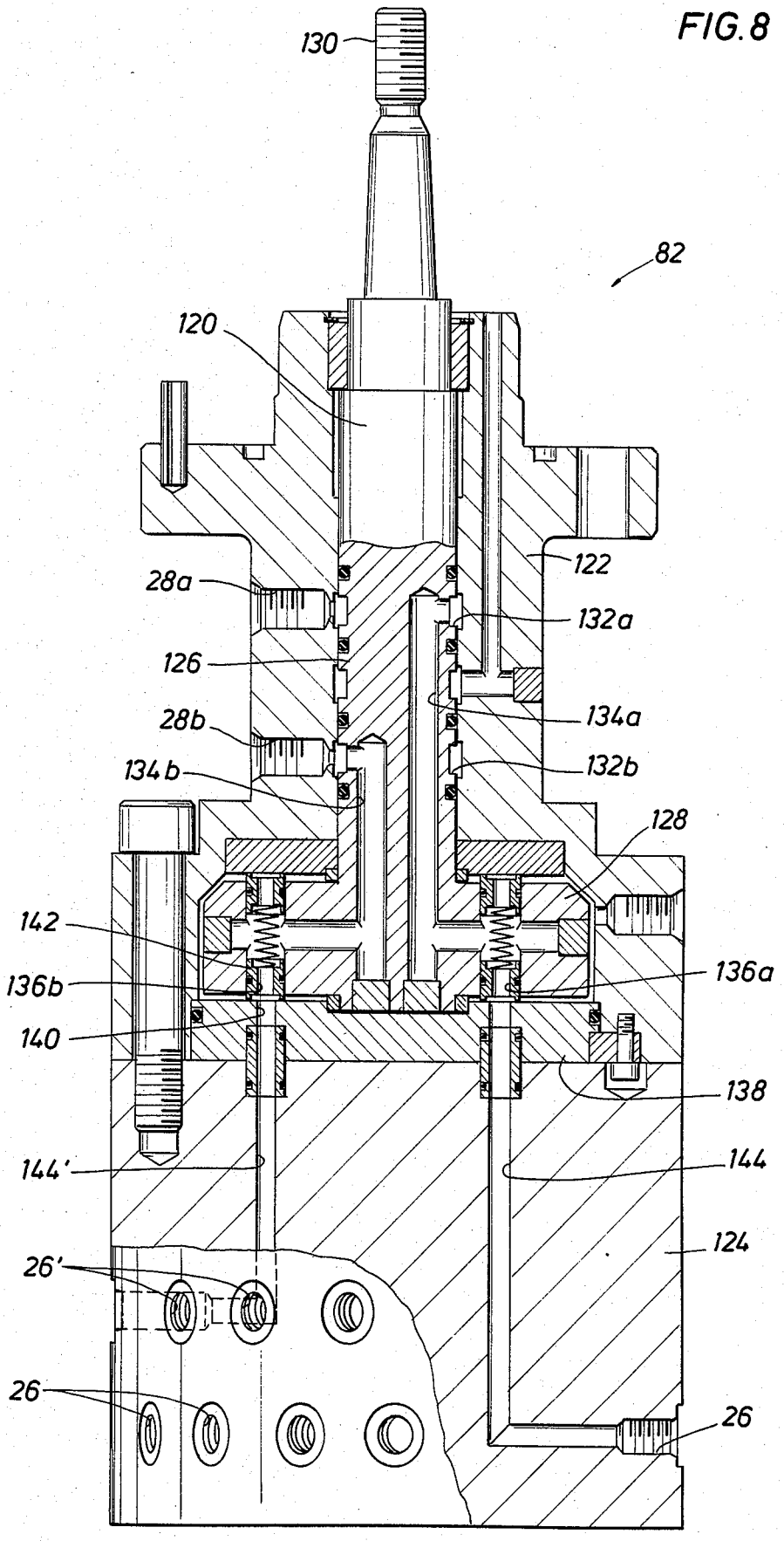
FIG. 8 shows a side view in axial cross section of a multiple position valve suitable for use in the present invention.

The multiple position valve 82 is preferably a two port input—2×16 port output rotary shear seal valve, the construction and operation of which is generally familiar to those skilled in the art. A preferred embodiment of such a multiple position valve 82 adapted for use in the present invention is shown in FIG. 8. The multiple position valve 82 has three primary components: a rotor 120, the angular position of which is controlled by the actuator 80; a rotor housing 122 which contains the input pressure ports 28*a,b*; and, an output port housing 124. The rotor housing 122 and output port housing 124 form the valve body of the multiple position valve 82. The rotor 120 serves as a moveable passageway element establishing fluid communication between the input pressure ports 28*a,b* and selected ones of the outlet pressure ports 26*a–h*.

It will be appreciated that other embodiments of the multiple position valve 82 could also be employed. The multiple position valve 82 could, for example, be a linear valve. All that is required is that there be some form of valve block or housing assembly containing the input port(s) and output port, and a fluid passageway element moveable to establish different fluid communication paths from the input port(s) 28 to selected ones of the outlet ports 26.

The rotor 120 has a central shaft portion 126, a fluid distribution end portion 128, and a drive portion 130 at which the rotor 120 is driven by the actuator 80. Circumferential grooves 132*a,b* in the surface of the central shaft portion 126 are aligned, respectively, with the two input pressure ports 28*a,b*. Rotor conduits 134*a,b* extend along the central shaft portion 126 in a generally axial direction and serve to place the input pressure ports 28*a,b* in fluid communication with fluid distribution ports 136*a,b* in the fluid distribution end portion 128. The fluid distribution ports 136*a,b* are spaced substantially 180° apart on the rotor 120 and are positioned at different radial distances from the axis of rotation of the rotor 120.

Positioned intermediate the fluid distribution end portion 128 and the output port housing 124 is a rotor housing endcap 138. The endcap 138 has two sets of 16 axial passages 140, the sets being arranged to form two concentric circles. The radii of these circles correspond, respectively, to the radial offset of the two rotor fluid distribution ports 136*a,b*. Within each of the circles, the axial passages 140 are equiangularly spaced. When the rotor 120 is positioned such that the first fluid distribution port 136*a* is aligned with one endcap axial passage 140 from the first set, the second fluid distribution port 136*b* is aligned with a corresponding axial passage 140 from the second set. Each 22.5° rotation of the rotor 120 will bring the fluid distribution ports 136*a,b* into alignment with a different pair of axial passages 140. Shear seals 142 are positioned in the fluid distribution ports 136*a,b* to maintain a sealed fluid interface between the fluid distribution ports 136*a,b* and the axial passages 140 with which they are aligned.

The output port housing 124 is secured in fixed relationship to the rotor housing 122. Two sets of 16 output pressure conduits 144, 144' in the output port housing 124 place each endcap axial passage 140 in fluid communication with a corresponding one of the two sets of 16 output pressure ports 26, 26'.

As shown in FIGS. 3 and 4, the multiple position valve 82 and actuator 80 are joined one to the other at a gear housing 146. A gear rack 148 extends through the gear housing 146 between the return piston 114 and the fourth actuator piston 88*d* and serves to transmit to the fourth piston 88*d* the restoring force applied by the return piston 114. The multiple position valve 82 is oriented relative to the gear housing 146 such that the rotor portion 130 terminates adjacent the gear rack 148, with the longitudinal axis of the rotor 120 being perpendicular to the longitudinal axis of the gear rack 148. A gear 150 affixed to the rotor interface end portion 130 is driven by the gear rack 148. Accordingly, motion of the actuator output member (the fourth piston 88*d*) causes the gear rack 148 to drive the rotor 120. The gear pitches of the gear rack 148 and gear 150 are established such that each of the 15 incremental units of motion possible by the fourth actuator piston 88*d* drives the rotor 120 through substantially 22.5°

Prior to assembly of the actuator to the multiple position valve 82, the actuator 80 is set to a known position (e.q. 0-0-0-0; that is, no input to any of the actuator pistons 88*a–d* such that the actuator output member is in the fully retracted position). The multiple position valve 82 is adjusted to provide the input port 28-output port 26 fluid communication path corresponding to this actuator position. The multiple position valve 82 is then affixed to the actuator 82 maintaining this relationship.

The best known mode of practicing the present invention has been described above. However, it is to be understood that this description is illustrative only and that other means and techniques can be employed without departing from the scope of the invention as set forth in the appended claims.

What is claimed is:

1. A valve for routing fluid from at least one fluid supply conduit to a selected one of a plurality of fluid receiving conduits, said valve comprising:

an input pressure port adapted to be placed in fluid communication with said fluid supply conduit;

a plurality of outlet pressure ports, each being adapted to be placed in fluid communication with a corresponding one of said fluid receiving conduits;

a fluid passageway element moveable through a number of positions relative to said outlet pressure ports, in at least some of said positions said fluid passageway element establishing fluid communication from said input pressure port to at least one of said outlet pressure ports;

an actuator having a plurality of code input ports and an output member moveable to a number of distinct positions, each of said code input ports being adapted to receive a pressure signal, there being two possible pressure signals associated with each code input port, a relatively high pressure signal and a relatively low pressure signal, the signal existing at a given time at each code input port defining one bit of a multi-bit select code, the actuator being adapted to adjust the output member to a position corresponding to the applied select code; and, means for interfacing the actuator output member and the fluid passageway element such that the application of a select code to the code input ports causes the routing valve to establish fluid communication from the inlet pressure port to an outlet port corresponding to said applied select code.

2. The valve as set forth in claim 1, wherein:

said input pressure port, said outlet pressure ports and said fluid passageway element are components of a rotary valve, said fluid passageway element defining a rotor of said rotory valve;

said actuator is a linear actuator, said output member extending from a fully retracted position a set amount for each select code; and, said interfacing means includes means for causing rotation of said rotor in response to linear movement of said actuator output member.

3. The valve as set forth in claim 1 wherein: said actuator has:

a housing defining a cylinder, said code input ports establishing fluid communication with said cylinder and being axially spaced one from the other along said housing;

a plurality of axially moveable pistons within said cylinder, each of said pistons being moveably connected to each adjacent piston, each of said pistons being associated with a corresponding one of said code input ports, said pistons each being adapted for axial extension of a predetermined amount in said cylinder in response to the application of a high pressure signal at the corresponding code input port; and, means for causing each piston to assume an unextended position in response to the absence of a high pressure signal at the corresponding code input port.

4. A system for controlling a plurality of subsea hydraulic valves from a surface control station, comprising:

a control conduit associated with each of said subsea valves, said subsea valves each being adapted to operate in response to the application of hydraulic pressure to the corresponding control conduit;

a hydraulic pressure supply;

a selector valve situated proximate the seafloor, said selector valve being adapted to establish fluid communication between said pressure supply and a selected one of said control conduits, said selector valve having:

a binary actuator having a plurality of code input ports and a moveable output member, each of said code input ports being adapted to receive a pressure signal controllably variable between two pressure levels, the pressure level at each code input port representing one bit of a multi-bit binary select code, each select code corresponding to a position of said output member, said binary actuator being adapted to adjust said output member to a position corresponding to the then-existing select code;

a multiple position valve having an inlet pressure port adapted for receiving pressurized fluid from said hydraulic pressure supply, a plurality of outlet pressure ports each in fluid communication with a corresponding control conduit, and a fluid passageway element adapted to be moved to a number of positions, each such position establishing fluid communication between said inlet pressure port and at least one of said outlet pressure ports; and, means for coupling said fluid passageway element to said actuator output member so that movement of said output member causes movement of said fluid passageway element, each position of said output member causing said passageway element to assume a corresponding position establishing fluid communication between said inlet pressure port and a corresponding outlet pressure port;

a plurality of code input conduits, each being in fluid communication with a corresponding one of the code input ports; and, means for applying to the code input conduits a select code corresponding to that one of the subsea hydraulic valves which it is desired to address.

5. The control system of claim 4, wherein said select code applying means is situated at said surface control station.

6. The control system of claim 4, wherein the control system is adapted to control a plurality of groups of subsea hydraulic valves, there being a plurality of selector valves, one selector for each of said groups of subsea hydraulic valves.

7. The control system of claim 6, wherein the selector valves each have at least a first and a second code input port, said first code input port of each selector valve being in parallel fluid communication with a single first code input conduit, and said second code input port of each selector valve being in fluid communication with a single second code input conduit, whereby the first code input port of each selector valve is supplied with a common signal and the second code input port of each selector valve is supplied with a common signal.

8. The control system of claim 6, wherein the flowpaths intermediate the select code applying means and the code input ports of the selector valves are arranged such that each selector valve receives a common select code.

9. The control system of claim 4, further including means for selectively connecting and disconnecting said input pressure port to said hydraulic pressure supply.

10. The control system of claim 6, further including means for selectively applying pressure from said hydraulic pressure supply to the input pressure port of a selected one of said selector valves.

11. The control system of claim 6, further including an additional selector valve for controlling the application of hydraulic pressure from said hydraulic pressure supply to said plurality of selector valves, said additional selector valve being adapted to receive a select code from a second means for applying a desired select code; each of the input pressure ports of said plurality of selector valves being in fluid communication with a corresponding one of the outlet pressure ports of said additional selector valve, the input pressure port of said additional selector valve being adapted to be placed in fluid communication with said pressurized hydraulic fluid supply; each select code applied to said additional selector valve by said second select code applying means causing said additional selector valve to establish a fluid communication path intermediate said additional selector valve input pressure port and that one of the additional selector valve outlet pressure ports corresponding to the select code applied by said second select code applying means.

12. A hydraulic selector valve for use in controlling a plurality of hydraulically actuated elements, comprising:

a binary actuator having a plurality of code input ports and a moveable output member, each of said code input ports being adapted to receive a pressure signal, there being two possible pressure signals associated with each code input port, one of said pressure signals being of a higher pressure level than the other, the signal existing at the code input ports at a given time defining the bits of a multi-bit binary select code, said binary actuator being adapted to adjust said output member to a position corresponding to the then-existing multi-bit select code, each select code representing a certain position of said output member; and, a multiple position valve having:

a valve body defining at least one input pressure port and a plurality of outlet pressure ports;

a fluid passageway element adapted to be moved to a number of positions, each such position establishing fluid communication between said input pressure port and at least one of said outlet pressure ports; and, means for coupling said fluid passageway element to said actuator output member such that movement of said output member causes movement of said fluid passageway element.

13. The hydraulic selector valve of claim 12, wherein: said binary actuator is a linear binary actuator having an output member being extendable and retractable through a range of positions, each position corresponding to at least one select code; said multiple position valve is a rotary valve; said fluid passageway element is a rotor of said multiple position valve; and, said coupling means is a rack and gear assembly.

14. The hydraulic selector valve of claim 13 wherein said multiple position valve has first and second input ports and first and second sets of outlet pressure ports, said fluid passageway element being adapted to establish fluid communication between said first input pressure port and a selected one of said first set of outlet pressure ports, and between said second input pressure port and a selected one of said second set of outlet pressure ports.

15. A system for controlling a plurality of groups of fluid-actuated valves from a central control station, comprising:

a control conduit associated with each of said valves, each of said valves being adapted to operate in response to the application of fluid pressure to the corresponding control conduit;

a fluid pressure supply;

a plurality of first selector valves and a second selector valve, each selector valve having:

an input pressure port;

a plurality of outlet pressure ports;

a plurality of code input ports, each adapted to receive a pressure signal which can be altered between a first pressure level and a second pressure level higher than said first pressure level, the pressure level at each code input port representing one bit of a binary select code, each output pressure port being represented by a corresponding binary select code; and, means for adjusting the selector valve upon receipt of a binary select code to establish fluid communication between the input pressure port and that one of the output pressure ports corresponding to the then-existing binary select code;

each one of said first selector valves being associated with one fluid-actuated valve group, each valve control conduit of said valve group being in fluid communication with a corresponding outlet pressure port of said first selector valve;

a plurality of first selector valve code input conduits, each being in fluid communications with a corresponding one of said first selector valve code input ports;

means for applying to said first selector valve code input conduits a select code corresponding to that one of the valves within each group which is to be operated;

said input pressure port of each first selector valve being in fluid communication with a corresponding one of the outlet pressure ports of said second selector valve, said second selector valve inlet pressure port being adapted to receive pressurized fluid from said fluid pressure supply;

a plurality of second selector valve code input conduits, each being in fluid communication with a corresponding one of said second selector valve code input ports; and, means for applying to said second selector valve code input conduits a select code corresponding to that one of the second selector valve outlet pressure ports which is in fluid communication with that one of the first selector valves which it is desired to operate.

16. The valve control system as set forth in claim 15, wherein the code input ports of said first selector valves are connected in parallel to a common set of first selector valve code input conduits.

17. The valve control system as set forth in claim 16, wherein said fluid-actuated valves are subsea hydraulic well control valves, each group of hydraulic well control valves corresponding to a single well.

18. The valve control system as set forth in claim 17, wherein the control station is located above the surface of the water, said first and second selector valve select code applying means being located at the control station.

19. The valve control system as set forth in claim 15, wherein the first and second selector valves include:

a binary actuator containing said code input ports and a moveable output member, each select code corresponding to a position of said output member, said binary actuator being adapted to adjust said output member to a position corresponding to the then-existing select code;

a multiple position valve containing said input and outlet pressure ports and a fluid passageway element adapted to be moved through a number of positions, each such position establishing fluid communication between said inlet pressure port and at least one of said outlet pressure ports; and means for coupling said fluid passageway element to said actuator output member so that movement of said output member causes movement of said fluid passageway element, each position of said output member causing said passageway element to assume a corresponding position establishing fluid communication between said inlet pressure port and a corresponding outlet pressure port.

20. The system as set forth in claim 15, wherein said fluid-actuated valves are double acting valves and wherein there are two control conduits associated with each of said valves, each of said control conduits being in fluid communication with a unique one of said first selector valve outlet pressure ports.

21. A control valve adapted for applying fluid pressure from a fluid pressure source to a selected one of a group of fluid conduits, said control valve comprising:

a valve body defining an input pressure port and a plurality of outlet pressure ports, said outlet pressure ports each being adapted to be placed in fluid communication with a corresponding one of said fluid conduits, said input pressure port being adapted to receive pressurized fluid from a source external to said control valve;

a fluid passageway element within said valve body, said fluid passageway element being moveable within said valve body through a series of positions, each outlet pressure port corresponding to one position of said fluid passageway element, said fluid passageway element being configured to establish fluid communication between said inlet pressure port and a selected one of said outlet pressure ports in response to said fluid passageway element being placed in the position corresponding to said selected outlet pressure port;

an actuator having a plurality of code input ports and an output member moveable through a number of positions, each of said code input ports being adapted to receive a pressure signal, each combination of pressure signals applied to said code input ports at a given time defining a select code, each select code corresponding to a position of said output member, said actuator being adapted to adjust said moveable output member to the position corresponding to the then-existing select code; and means for coupling said fluid passageway element to said actuator output member so that the application of a select code to said code input ports causes said fluid passageway element to be driven by said actuator output member to a position corresponding to such select code.

22. The control valve as set forth in claim 21, wherein the valve body defines at least two inlet pressure ports, each of said inlet pressure ports having a corresponding set of outlet pressure ports, and wherein for each position of the fluid passageway element fluid communication is established between each inlet pressure port and a corresponding outlet pressure port in the corresponding outlet pressure port set.

23. The control valve as set forth in claim 21, wherein said valve body and fluid passageway element are elements of a rotary valve, said fluid passageway element being the rotor of said rotary valve.

24. The control valve as set forth in claim 21, wherein said actuator is a linear binary actuator.

25. A system for operating a plurality of control valves in a subsea well control system, each of said valves having first and second control ports, said system comprising:

a surface control station;

a selector valve situated proximate the seafloor, said selector valve having:

a binary actuator having a plurality of code input ports and a moveable output member, each of said code input ports being adapted to receive a hydraulic signal controllably variable between two pressure levels, the pressure level at each code input port representing one bit of a multi-bit binary select code, each select code corresponding to a position of said output member, said binary actuator being adapted to adjust said output member to a position corresponding to the then-existing select code;

a multiple position valve having first and second inlet pressure ports, first and second sets of outlet pressure ports, and a fluid passageway element adapted to be moved through a number of positions, each such position establishing hydraulic communication between said first inlet pressure port and one of said first outlet pressure ports and between said second inlet pressure port and one of said second outlet pressure ports; and, means for coupling said fluid passageway element to said actuator.output member so that movement of said output member causes movement of said fluid passageway element, each position of said output member causing said passageway element to assume a corresponding position establishing hydraulic communication between said first inlet pressure port and one of said first outlet pressure ports and between said second inlet pressure port and one of said second outlet pressure ports;

a first and a second control conduit associated with each of said control valves, said first control conduit establishing hydraulic communication between said first control port and a corresponding one of said first outlet pressure ports and said second control conduit establishing hydraulic communication between said second control port and a corresponding one of said second outlet pressure ports, the first and second outlet pressure port pair associated with each control conduit pair corresponding to a single position of said fluid passageway element, whereby each position of said fluid passageway element establishes fluid communication between said first selector valve inlet pressure port and the first control port of the control valve corresponding to that position and between said second selector valve inlet pressure port and the second control port of said control valve corresponding to that position;

a plurality of code input conduits, each being in fluid communication with a corresponding one of said code input ports;

means for applying to said code input conduits a select code corresponding to that one of the control valves which it is desired to address; and, means for applying hydraulic pressure to a selected one of said first and second inlet pressure ports.

26. The control system of claim 25, wherein said control valves are latching piloted control valves, each of said piloted control valves controlling the operation of a hydraulically actuated component of a subsea well.

27. The control system of claim 25, wherein the system is adapted to control a plurality of groups of subsea hydraulic control valves, there being a plurality of selector valves, one selector valve for each of said groups of subsea hydraulic control valves.

28. The control system of claim 27, wherein said means for applying hydraulic pressure to a selected one of said first and second inlet pressure ports of said plurality of selected valves includes a master selector valve, said master selector valve being adapted to receive a select code from a second means for applying a select code; each of the two inlet pressure ports of said first selector valves being in hydraulic communication with a corresponding pair of the outlet pressure ports of said master selector valve.

29. The control system of claim 28, wherein the two master selector valve outlet pressure ports corresponding to each first selector valve correspond to a single position of the master selector valve fluid passageway element, whereby once a selected control valve is addressed by application of the appropriate select codes to said master selector valve and said plurality of selector valves, hydraulic pressure may be applied to the first and second control ports of said selected control valve in any sequence with the select codes remaining unchanged.

* * * * *